US006373678B1

(12) United States Patent
Bartsch et al.

(10) Patent No.: US 6,373,678 B1
(45) Date of Patent: Apr. 16, 2002

(54) METHOD OF REGULATING THE ARMATURE IMPACT SPEED IN AN ELECTROMAGNETIC ACTUATOR BY CONTROLLING THE CURRENT SUPPLY BASED ON PERFORMANCE CHARACTERISTICS

(75) Inventors: Leonhardt Bartsch, Aachen; Lutz Kather, Würselen; Hans Kemper, Aachen; Frank Van Der Staay, Würselen, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/564,050

(22) Filed: May 3, 2000

(30) Foreign Application Priority Data

May 3, 1999 (DE) ..... 199 20 181

(51) Int. Cl.[7] ..... H01H 50/16
(52) U.S. Cl. ..... 361/160; 361/152
(58) Field of Search ..... 361/143, 152–156, 361/160, 170

(56) References Cited

U.S. PATENT DOCUMENTS 5,818,680 A * 10/1998 Schmitz et al. ..... 361/160
5,905,625 A * 5/1999 Schebitz ..... 361/154
6,141,201 A * 10/2000 Schmitz ..... 361/154

* cited by examiner

*Primary Examiner*—Ronald W. Leja
(74) *Attorney, Agent, or Firm*—Venable; Gabor J. Kelemen

(57) ABSTRACT

A method of controlling a supply current applied to an electromagnet of an electromagnetic actuator by a control unit for obtaining a low impact speed of a reciprocating armature of the actuator upon arrival of the armature at a pole face of the electromagnet, includes the following steps: during travel of the armature toward the pole face detecting displacements of the armature and a sequence of the armature speed as actual values; comparing the actual values with a performance characteristic field stored in the control unit and relating to a predetermined relationship between armature speed and armature displacement for the armature travel toward the pole face; determining a desired value for the supply current from the comparison step; comparing an actual value for the supply current with the determined desired value; adjusting the supply current based on a difference between the actual and desired values; and applying the adjusted supply current to the electromagnet.

1 Claim, 3 Drawing Sheets

METHOD OF REGULATING THE ARMATURE IMPACT SPEED IN AN ELECTROMAGNETIC ACTUATOR BY CONTROLLING THE CURRENT SUPPLY BASED ON PERFORMANCE CHARACTERISTICS

CROSS REFERENCE TO RELATED APPLICATION

This application claims the priority of German Application No. 199 20 181.1 filed May 3, 1999, which is incorporated herein by reference.

BACKGROUND OF THE INVENTION

Electromagnetic actuators are essentially composed of at least one electromagnet and an armature which is coupled with a component to be driven by the actuator. The armature is movable, against the force of a resetting spring, by an electromagnetic field generated by the electromagnet when it is supplied with current. Such electromagnetic actuators are characterized by high armature speeds (switching speeds).

Electromagnets of the above type involve the problem that when the armature approaches the pole face of the attracting electromagnet and thus the distance between armature and pole face decreases, that is, the air gap between the pole face and the armature diminishes, the magnetic force affecting the armature exponentially increases, while, as a rule, the counter force of the resetting spring increases only linearly. As a result, the armature impacts on the pole face with increasing speed. Apart from noise generation, rebound phenomena may occur, that is, the armature first impacts on the pole face then lifts off at least for a short period until it assumes its position of rest in contact with the pole face. This occurrence may adversely affect the functioning of the driven component which, in turn, may lead to malfunctions or significant disturbances in actuators operating with high switching frequencies.

It is therefore desirable to ensure that the impact velocity of the armature is in the order of magnitude below 0.05 m/s. It is of importance that such low impact speeds are ensured under real operational conditions as well, together with all the stochastic oscillations involved therewith. External interferences such as shocks, jars or the like may, in the final approach of the armature or even after its engagement on the pole face lead to a sudden drop of the armature from the pole face.

SUMMARY OF THE INVENTION

It is an object of the invention to provide an improved regulating process which, in electromagnetic actuators of the above-outlined type, makes possible to so control the motion of the armature by controlling the current supply to the electromagnet that the armature arrives at its seat on the pole face with a low impact velocity. A sufficient holding force after arrival of the armature on the pole face has to be ensured by the engine control unit by providing a suitably regulated holding current.

This object and others to become apparent as the specification progresses, are accomplished by the invention, according to which, briefly stated, the method of controlling a supply current applied to an electromagnet of an electromagnetic actuator by a control unit for obtaining a low impact speed of a reciprocating armature of the actuator upon arrival of the armature at a pole face of the electromagnet, includes the following steps: during travel of the armature toward the pole face detecting displacements of the armature and a sequence of the armature speed as actual values; comparing the actual values with a performance characteristic field stored in the control unit and relating to a predetermined relationship between armature speed and armature displacement for the armature travel toward the pole face; determining a desired value for the supply current from the comparison step; comparing an actual value for the supply current with the determined desired value; adjusting the supply current based on a difference between the actual and desired values; and applying the adjusted supply current to the electromagnet.

The above-outlined process takes advantage of up-to-date, high-speed electronic computer components. It is thus feasible to determine the momentary position and/or the velocity of the armature not only during the switching process, but it is also possible to detect the motion behavior of a plurality of actuators and to process the required motion magnitudes. Further, in case of deviations from desired values, it is feasible, by means of a suitable regulating step, to ensure for each individual actuator an optimal course for each switching cycle.

The method according to the invention advantageously utilizes the fact that a performance characteristic field inputted into the engine control unit determines the required relationship between the armature speed and the armature displacement for producing desired values of the current supply. Further, by determining the actual values of the armature motion as related to the armature displacement and armature speed, interfering factors may be controlled by changing, based on performance characteristics, the desired values for the current regulator and thus the actual value for the current of the "capturing" electromagnet and thus the magnetic energy feed. This control is performed in a such a manner that the armature arrives at the pole face with an impacting speed which is only slightly above an ideal "zero" impact speed. "Performance characteristics" ("characteristic field") within the meaning of the invention encompasses a single set of performance characteristics as well as a system of such sets which apply to a number of operating conditions.

DESCRIPTION OF THE PREFERRED EMBODIMENT

Figure 1:
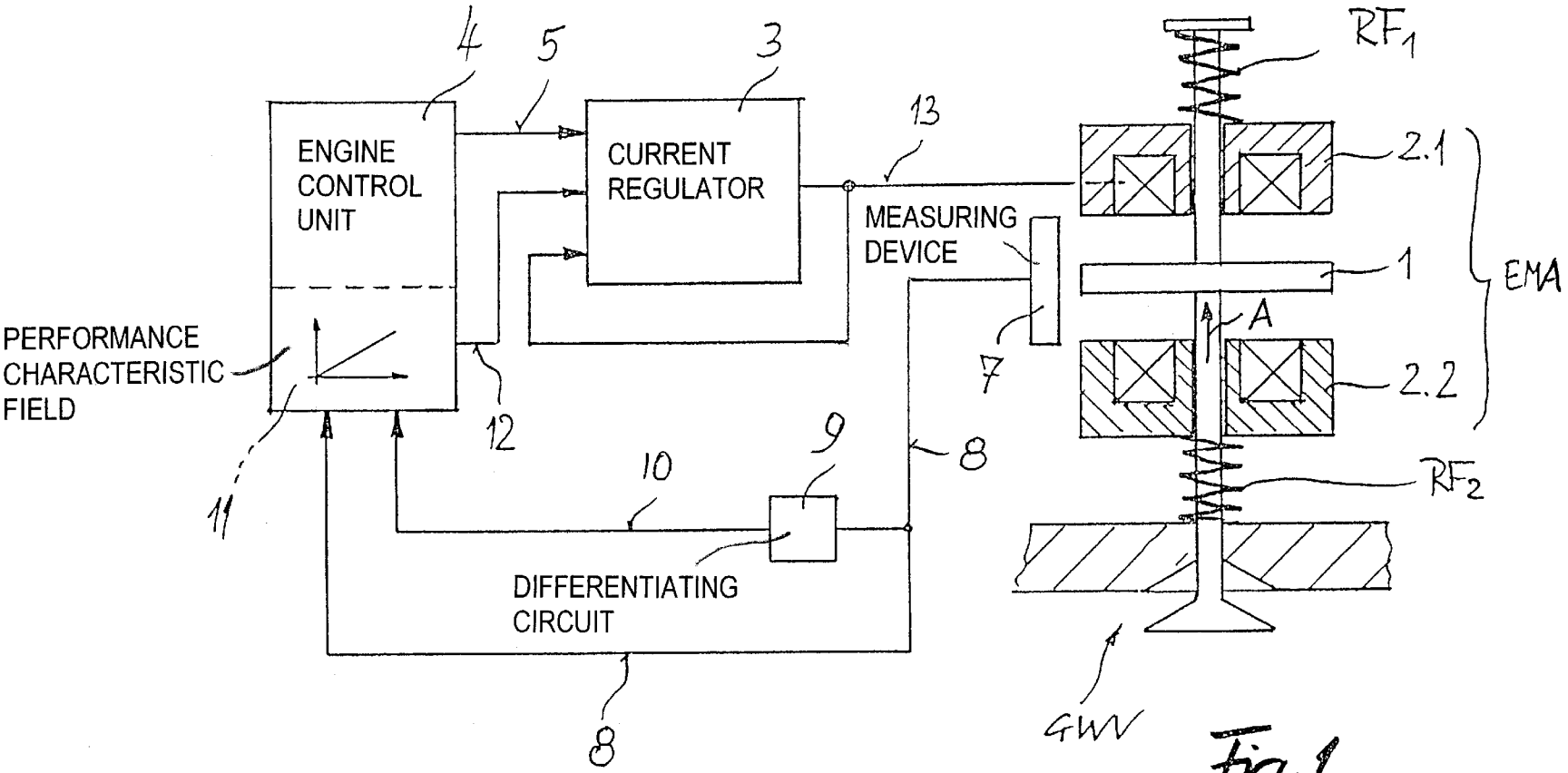
FIG. 1 is a block diagram for an electromagnetic actuator for operating a cylinder valve in a piston-type internal combustion engine.

The circuit diagram in FIG. 1 schematically shows a cylinder valve GWV forming a component of a piston-type internal combustion engine and provided with an electromagnetic actuator EMA as a valve drive. The actuator EMA essentially comprises a closing magnet 2.1 and an opening magnet 2.2, between which an armature 1 is reciprocated as a function of current supplied to the electromagnets 2.1 and 2.2. Such armature motion is opposed by respective resetting springs RF1 and RF2. The two possible switching positions for the cylinder valve GWV (constituting the driven component), are respectively defined by the armature lying against the pole face of the two electromagnets 2.1 or 2.2.

In the description which follows, the control method for supplying current to the closing magnet 2.1 will be described. It will be understood that the opening magnet 2.2 is supplied with current in the same manner.

In FIG. 1 the armature 1 is shown in an intermediate position, following the shut-down of the current for the opening magnet 2.2 and after the armature is moved by the force of the spring RF2 in the direction of the closing magnet 2.1, as indicated by the arrow A. The current supplied to the respective magnets 2.1, 2.2 controls the reciprocating movement of armature 1. The movement in the direction of arrow A is controlled by the current supplied to the capturing closing magnet 2.1, so that, after the armature has passed its mid position between the electromagnets 2.1, 2.2, a magnetic force acts upon the armature 1 against the force of the resetting spring RF1 adjoining the closing magnet 2.1. In case the counter force of the spring RF1 is large, it may be expedient to supply current to the capturing magnet immediately after the armature is released by the holding magnet. As a rule, with increasing approach of the armature 1 to the pole face of magnet 2.1 the spring force increases linearly, while the; magnetic force increases progressively (exponentially) assuming an unregulated current supply. Thus, the closer the armature to the electromagnet, the greater the increase in the excess magnetic force, resulting in an increased acceleration of the armature 1. Thus, the armature impacts at a high speed on the pole face, causing a noise to develop and, despite the presence of the magnetic field, may lift off the pole face to an extent dependent on the impact speed. Such rebound phenomena are disadvantageous for the valve closing and valve opening processes. Thus, the energy supply to the armature by way of the magnetic field should be adjusted by controlling the current supply in such a manner that the armature impacts on the pole face at a nearly "zero" speed. Subsequently, the current applied to the electromagnet may be adjusted to function as a holding current.

The current is supplied by a current regulator 3 which, in turn, receives commands for supplying current from an engine control unit 4. At least the current cut-off signals 5 are transmitted to the current regulator 3.

A detecting and/or measuring device 7 is associated with the electromagnetic actuator EMA to be able to control the current by considering actual conditions which can change during the operation and also during the course of a longer service period. Such a displacement detection may be based on a direct sensing, or based on other characteristic data, as will be described later. The engine control unit 4 is supplied with the armature displacement signal 8 obtained with the measuring device 7 and a speed signal 10 that is derived with the aid of a differentiating circuit 9.

In order to process the armature displacement signal 8 and the speed signal 10, the engine control unit 4 is provided with a performance characteristic field or field system 11 having performance characteristic fields for several actuators. In such a field or field system the speed/displacement function is predetermined either empirically or by computation using characteristic data of the actuator. The speed/displacement curve is plotted such that it shows a desired low impact speed below 0.05 m/s. A curve for a desired current value is associated with the speed curve predetermined by the performance characteristic field.

If the detected displacement signal 8 (sensed by the measuring device 7) and the speed signal 10 derived therefrom correspond in their actual course to the predetermined performance characteristic field, then the desired current value corresponds to the value specified by the performance characteristic field. If, however, a comparison with the stored performance characteristic field shows deviations in the relationship between speed signal and displacement signal, the desired current value is corrected accordingly.

The thus obtained and, if required, corrected desired current value 12 is then applied to the current regulator 3, in which the actual current value 13 is also detected, so that the actual current value 13 for supplying the electromagnet 2.1 may be accordingly adjusted relative to the desired current value 12 (corrected, if desired).

Since instead of being an inflexible predetermined value, the desired current value 12 itself is corrected by taking into account the detected actual movement behavior at the actuator by way of the predetermined performance characteristic field or field system 11 for the engine control unit, it is possible to eliminate by regulation any interference that may affect the movement behavior of the actuator.

A wide variety of methods can be used to detect the armature displacement and/or armature speed. For example, it is possible to derive a displacement signal and a speed signal by detecting the displacement-dependent change in the resetting force of the resetting spring RF1 or RF2 by piezoelectric transmitters connected to the support of the resetting springs RF1 and RF2.

It is also possible to dispose a LED "shadow sensor" in the region of the armature 1. In such a sensor the measured value is represented by the change in the light intensity caused by a stroke-dependent shadow formation during the armature movement. From the measured value the actual armature position and armature displacement can be determined, from which the armature speed may be derived.

An arrangement of "direction-sensing" sensors at the electromagnets also permit a detection of the changing armature position and thus the armature displacement by detecting the change in the direction of the magnetic field lines. The principal magnetic field as well as the stray magnetic field of the electromagnet can be measured with a suitable arrangement and the armature displacement can be derived from the positional changes of the armature.

Since it is particularly important to detect the armature movement near the pole face of the electromagnet, it is also feasible to sense the armature movement by capacitive sensors by detecting a change in their capacity which, in turn, depends from the armature position (stroke). For this purpose, however, high-frequency excitation frequencies in the MHz range are required.

It is noted that the term "end position" of the armature 1 as used in this description also applies to the positions assumed by the armature when, provided a valve clearance (slack) is present, the valve attains its seated state.

As a basic rule concerning the control of the current supply, a switch-over to a holding current (which may be cyclical) occurs when the armature has reached its end position.

The previously described method for reducing the impact speed of the armature (and the cylinder valve) also takes into account the appearance of major movement losses, since the control of the current supply based on the armature speed in dependence on the armature displacement compels the regulator to operate on the safe side. A "starving" of the armature, that is, a situation where the armature is incapable of reaching the pole face of the momentarily capturing electromagnet is securely prevented, because a sufficient energy is always made available for the armature to perform its intended motion. Problems primarily involve cylinder valves which must open against large gas forces.

For plotting the performance characteristic field 11, the measured or reconstructed "displacement" and speed" values are addressed to a field. Desired current values are taken directly from the performance characteristic field in such a manner that at all times an optimal current supply is made available which is based on a close-to-true actuator model and which makes possible an arrival (impact) speed of approximately zero. Such an operation is performed according to the graph in FIG. 2 by numerically solving the differential equation system of the actuator model, in that an integration back in time is performed from the moment the armature makes contact at low impact speed (point A in the sector for the state). In the process, the respective value range for the predetermined current is traversed through in sufficiently small increments for each displacement element $\Delta s=s_i-s_{i-1}$ which corresponds to the path distance between two neighboring points in the performance characteristic diagram and for each meaningful speed $v_j$ of the performance characteristic at the location $s_j$. The purpose is to obtain such a desired current value for each meaningful speed $v_j$ at the location $s_{i-1}$ which securely leads to the starting point A. An additional value measure can be used to select an optimum value from several possible desired current values.

Figure 2:
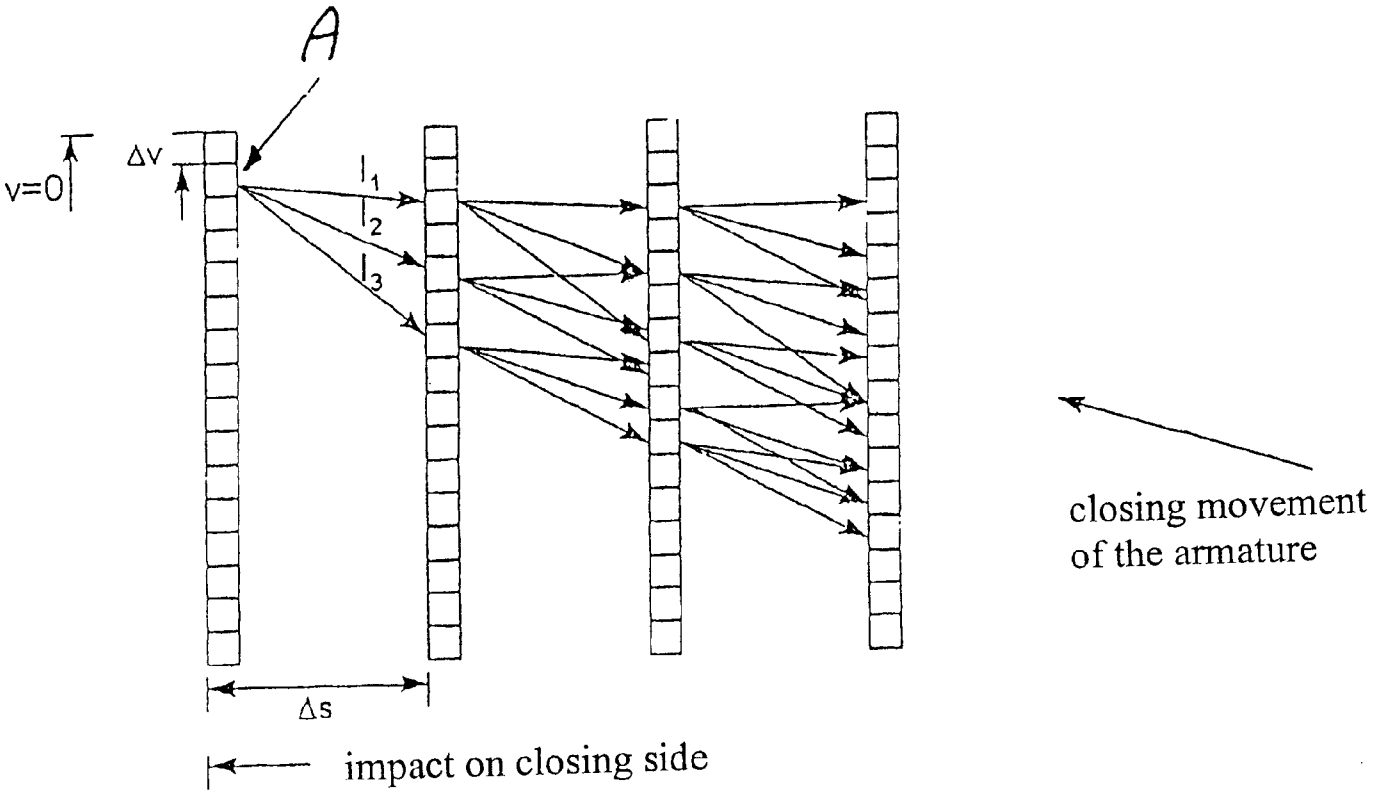
FIG. 2 is a schematic representation of plotting a performance characteristic field.
Figure 3:
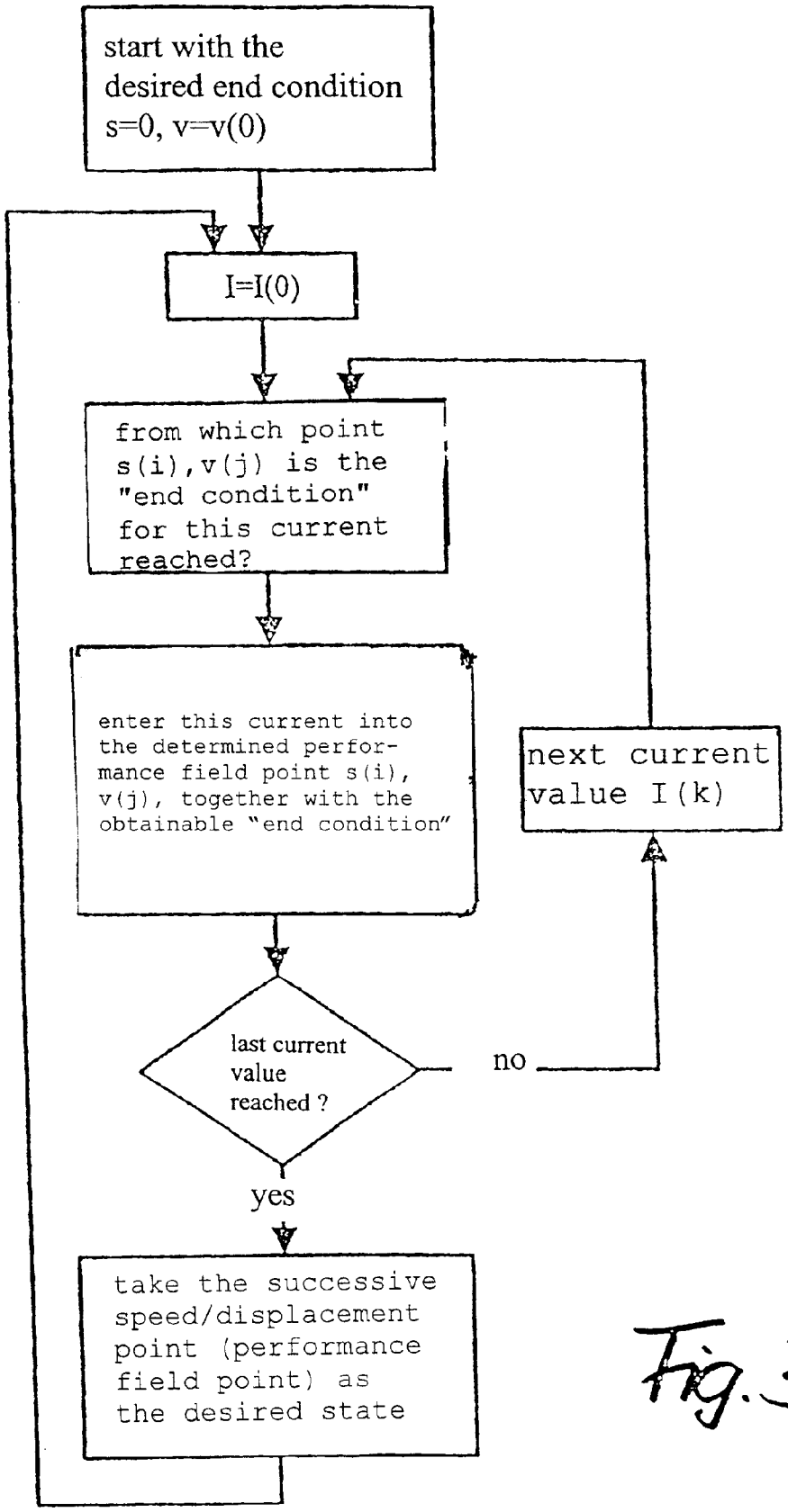
FIG. 3 is a flow chart for plotting a performance characteristic field.

The flow chart shown in FIG. 3 shows the sequence of steps taken to plot the performance characteristic field shown schematically in FIG. 2, by performing a backward computation with a computer. The starting point is the desired end state, that is, s=0 (in which the armature contacts the pole face of the electromagnet) and a specific desired impact speed v=v(0). Starting from that point, based on the force equations, computations are made with the aid of the model to determine which state (s(i), v(j)) must have existed shortly before, assuming a specific current. A backward computation of this type makes possible to determine for different current values which "pre-condition" of the current will lead to the desired "end state." This current value is then entered at the corresponding field point which corresponds to the respective pre-condition. This process is repeated until all meaningful current values have been accounted for, as shown in FIG. 2.

Following the first passage through all possible current values, new optional performance characteristic points are obtained, which permit reaching the final end position. These performance characteristic points can be seen in FIG. 2 as the second column from the left. The computation backward to the third column is then started for each of these points. Each point is viewed as a new "desired state" and the backward computation is performed for each of these points for all meaningful currents. Thus, a "pre-condition" s(i), v(j) is determined for each point for each current, which will lead to the desired state for the corresponding current. Thus, it is also possible that a "pre-condition" will lead to several valid "desired" states for various currents. Initially, the current as well as the "end condition" or desired state reachable thereby must be stored at each performance characteristic point.

In conclusion, a selection must be made between the possible currents in a field point. For this purpose a quality measure can be determined which is used to effect an evaluation of the data entered into the field point. Such a quality measure can be determined from the characteristic field, for example, on the basis of a trajectory considered particularly meaningful (the fewer the deviations from the trajectory, the better the data entered into the performance characteristic field). Or, other criteria for selecting the final performance characteristic entries may be used, such as a current that must changed as little as possible.

It will be understood that the above description of the present invention is susceptible to various modifications, changes and adaptations, and the same are intended to be comprehended within the meaning and range of equivalents of the appended claim.

What is claimed is:

1. A method of controlling a supply current applied to an electromagnet of an electromagnetic actuator by a control unit for obtaining a low impact speed of a reciprocating armature of the actuator upon arrival of the armature at a pole face of the electromagnet, comprising the following steps:

(a) detecting displacements of the armature and momentary armature speeds as actual values during travel of the armature toward the pole face;

(b) comparing said actual values with a performance characteristic field stored in the control unit and relating to a predetermined relationship between armature speed and armature displacement for the armature travel toward the pole face;

(c) determining a desired value for the supply current from step (b);

(d) comparing an actual value for the supply current with said desired value;

(e) adjusting the supply current based on a difference between the actual and desired values as determined in step (d); and (f) applying to the electromagnet the supply current adjusted in step (e).

* * * * *